United States Patent [19]

Fujiwara et al.

[11] 4,346,356

[45] Aug. 24, 1982

[54] CIRCUIT BREAKER WITH INCREASED CONTACT SEPARATION

[75] Inventors: Kohei Fujiwara; Setsuo Hosogai, both of Fukuyama, Japan

[73] Assignee: Mitsubishi Denki Kabushiki Kaisha, Tokyo, Japan

[21] Appl. No.: 233,234

[22] Filed: Feb. 10, 1981

[30] Foreign Application Priority Data

Feb. 19, 1980 [JP] Japan ..... 55-19866[U]

[51] Int. Cl.[3] ..... H01H 75/00; H01H 77/00; H01H 83/00

[52] U.S. Cl. ..... 335/6; 335/14; 335/174

[58] Field of Search ..... 335/23, 35, 21, 22, 335/43, 174, 14, 15, 16, 6

[56] References Cited

U.S. PATENT DOCUMENTS 3,599,130 8/1971 Murai et al. ..... 335/174

*Primary Examiner*—Harold Broome

*Attorney, Agent, or Firm*—Sughrue, Mion, Zinn, Macpeak and Seas

[57] ABSTRACT

A circuit breaker having a larger separation distance between a stationary contact 4 and a movable contact 6 in the automatic mode than in the manual mode. The pivot shaft 24 of a crank 13 is placed in a higher position than in a conventional circuit breaker, to thereby enable the arm 7 carrying the movable contact 6 to rotate through a greater angle. A stop plate 26 is provided to prevent the flex angle $\theta$ formed between a first link 11 and a second link 12 of a toggle mechanism 10 from becoming too small when the contacts are opened, which enables easy manual closure with the normal stroke of a switch handle 16 and avoids the need for a stronger spring 17.

5 Claims, 5 Drawing Figures

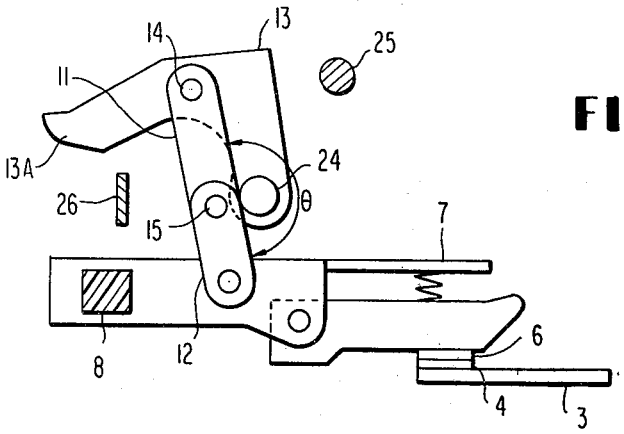
FIG. 3
FIG. 4
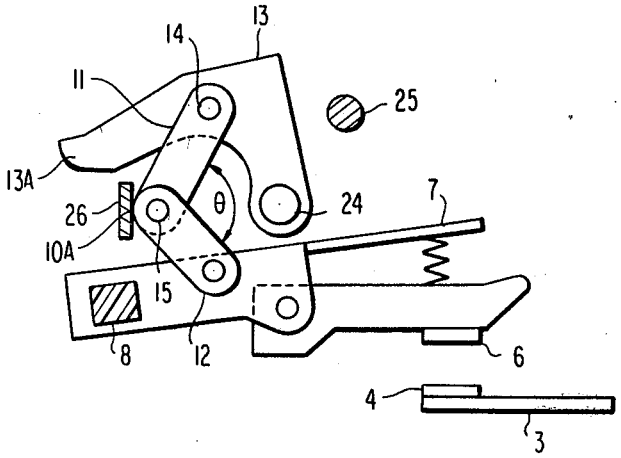
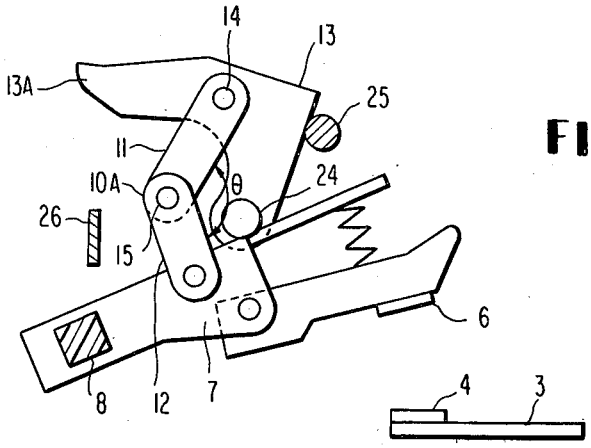
FIG. 5

CIRCUIT BREAKER WITH INCREASED CONTACT SEPARATION

BACKGROUND OF THE INVENTION

1. Field of the Invention

This invention relates to an improved circuit breaker having a toggle link mechanism in which the separation distance between a movable contact and a stationary contact is larger for automatic or overcurrent operation than for manual operation.

2. Description of the Prior Art

Circuit breakers having a toggle mechanism are widely used in industrial, commercial, and residential environments for protecting power distribution equipment against damage from overcurrents, short-circuit currents, and other abnormal electrical conditions, as is well known. A conventional circuit breaker of this type is shown in FIG. 1, wherein reference numeral 1 designates an insulating cover, numeral 2 an insulating base which forms a housing or case for a three-phase or three-pole circuit breaker in conjunction with the cover, and numeral 3 stationary conductors which are employed in all poles, one of which is shown, each having a stationary contact 4 at its left end portion. The other ends of the stationary conductors 3 are used as connection terminals for external conductors. Numeral 5 designates a movable contact assembly provided for each pole and composed of a movable contact 6 facing the stationary contact 4 and a movable contact arm 7 fixed to a common cross bar 8 for the simultaneous opening and closing of all contacts. Numeral 9 designates an arc extinguishing chamber provided for each pole and enclosing the corresponding stationary and movable contacts 4 and 6, and numeral 10 a toggle mechanism having a first link 11 and a second link 12 and being coupled with the center one of the three poles. One of the ends of the first link 11 is pivoted to the center portion of an L-shaped bell crank 13 by shaft 14, and the other end is pivoted to one of the ends of the second link 12. The other end of the link 12 is pivoted to the center portion of the movable contact arm 7.

Numeral 16 designates a switch handle for manually opening and closing the circuit breaker or interrupter, numeral 17 an operating spring whose one end is engaged with the handle 16 and the other end with the shaft 15 of the toggle link mechanism 10. The spring 17 is expanded and under tension in the closed position of the movable contact 6. Numerals 18 and 19 designate a thermal tripping mechanism and a magnetic tripping mechanism, respectively, both of which are designed to rotate a trip bar 22 around a pivot pin 22A in a counterclockwise direction by their action. The trip bar 22 is rotated by the thermally induced bending action of a bimetallic strip 20 of the thermal trip mechanism 18 when the current flowing through the strip increases to an overcurrent level, or by the magnetic attraction of a movable trip yoke 21 when the instantaneous current rises to an extremely high level, that is, a short-circuit current. Numeral 23 designates a spring biased latch whose one end 23A is engaged with one portion of the trip bar 22, i.e., one end 21A of the movable trip yoke 21, and whose other end 23B is held engaged with one end 13A of the crank 13 during both the closed and manually open conditions of the movable contact 6.

If the handle 16 is pulled towards the closed position when the crank 13 is engaged with the latch 23, the shaft 15 is moved to the right, and the toggle link mechanism 10 extends or straightens. The further movement of the shaft 15 is limited when the toggle link mechanism strikes the shaft 24 of the crank 13, by which time the movable contact 6 has engaged the stationary contact 4 in accordance with the extending action of the toggle link mechanism.

When the handle 16 is pulled to the open position, i.e. to the left in FIG. 1, the toggle link mechanism 10 is pivoted about the shaft 15. This pulls up on the movable contact arm 7 and rotates it in a counterclockwise direction around and with the cross bar 8 to open or break the contacts 4, 6. Such rotation is limited by the arm 7 striking against the crank pivot shaft 24, commonly called the first stop.

If there is an overcurrent or a transient peak in the circuit the contact between the crank 13 and the latch 23 is broken, the released crank rotates in the clockwise direction around the shaft 24, and is limited in its rotation by striking against the stationary shaft 25, commonly called the second stop. In this automatically opening action, as the shaft 14 connecting the crank 13 with the upper link 11 crosses over the line of action of the spring 17 due to the release of the crank by the latch 23, the toggle link mechanism 10 is pivoted about the shaft 15 by the restoring force of the extended spring. The flexing of the toggle link mechanism causes the counterclockwise rotation of the movable contact arm 7 and cross bar 8, whereby the contacts 4, 6 of each pole are opened simultaneously.

To improve this conventional circuit breaker it is desirable that the first stop, i.e., the shaft 24, to disposed at a higher position within the housing in order to increase the current interrupting capacity by lengthening the separation or arcing distance between the opened movable and stationary contacts 6, 4. In other words, a higher position of the first stop 24 would permit the rotation of the contact arm 7 over a larger angle, i.e., a larger moving stroke of the contact 6. It would also result in a smaller angle $\theta$ between the flexed upper and lower links 11, 12 when the contacts are open, however, and this would make it considerably more difficult to reclose the contacts. To overcome such difficulty a larger throw angle of the handle 16 would be required so that the center line of the spring 17 could pass over the shaft 14 during the clockwise rotation of the handle around the shaft 15 to the closed position, and a larger force from the spring 17 would also be required.

Such compensating modifications would be difficult, however, due to the size limitations imposed by the circuit breaker case, the size of the altered parts, and/or their cost, and the present invention thus seeks to overcome these difficulties.

SUMMARY OF THE INVENTION

It is thus an object of this invention to provide a new and improved circuit breaker in which the separation distance of the contacts in the automatic tripping mode is increased without increasing the spring strength and/or the operating stroke of the switch handle. To implement this object the location of the crank pivot shaft in the circuit breaker housing is raised to permit a greater rotation of the movable contact arm and thereby an increased separation distance between the stationary and movable contacts, and at the same time a third stop or abutment plate is provided to limit the flexure or bending of the toggle mechanism links and thereby prevent the angle between the links from decreasing below a relatively large value. This enables the breaker contacts to be closed with a normal switch handle stroke and without increasing the spring strength, which would otherwise require an increased closure force.

BRIEF DESCRIPTION OF THE DRAWINGS

In the accompanying drawings:

FIG. 3 is a partial view showing the circuit breaker of this invention with the contacts closed, FIG. 4 is a partial view showing the circuit breaker with the contacts manually opened, and FIG. 5 is a partial view showing the circuit breaker with the contacts automatically opened.

DETAILED DESCRIPTION OF THE PREFERRED EMBODIMENT

Figure 1:
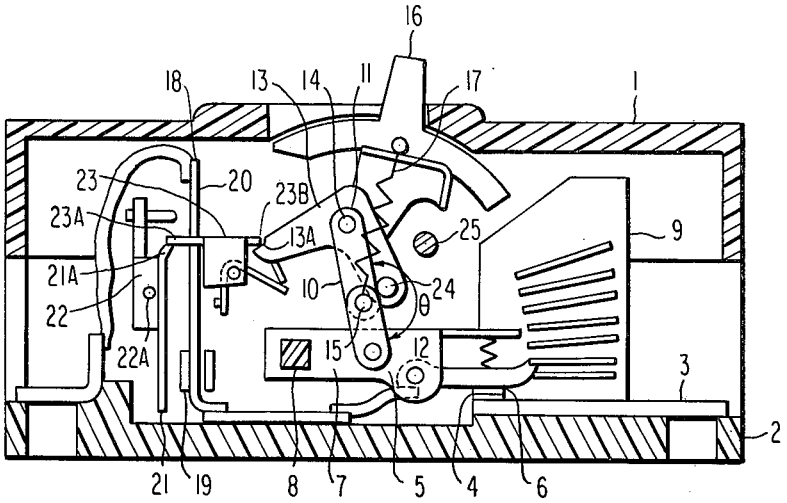
FIG. 1 PRIOR ART
FIG. 1 is a cross sectional view of a conventional circuit breaker.

Referring to FIGS. 2 through 5, this invention is characterized by providing a third stop 26, and by locating the crank pivot shaft 24 at a higher position, thereby making the distance between the pivot shaft and the contact arm 7 larger than shown in FIG. 1.

Figure 2:
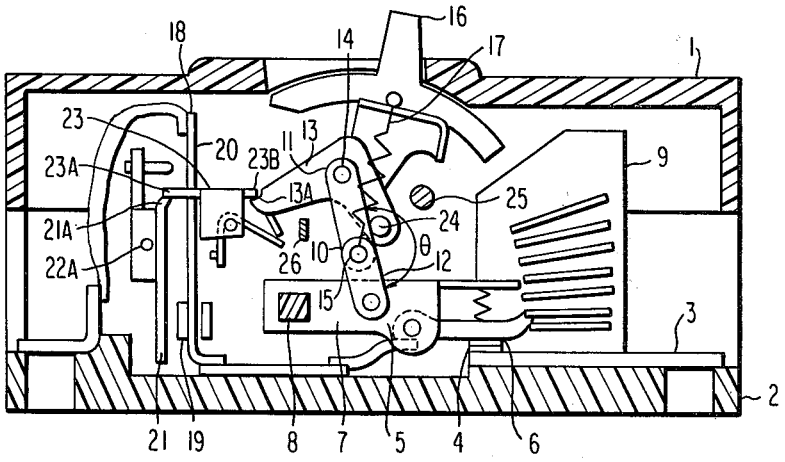
FIG. 2 is a cross sectional view of a circuit breaker according to this invention.

The third stop 26 consists of a flat metal plate, and is disposed at approximately the same level as the shaft 24. The other components of the circuit breaker shown in FIG. 2 are constructed and arranged in the same way as shown in FIG. 1.

In the operation of the circuit breaker of the invention, when the stationary contact 4 and the movable contact 6 are in the closed position, the configuration is as shown in FIG. 3. When the breaker is opened manually by handle 16, the toggle link mechanism 10 operates in the same way as the conventional breaker. Consequently, the shaft 15 moves in a clockwise direction around the shaft 14 forming an angle $\theta$ between the links 11 and 12 of less than 180 degrees when the leading edge 10A of the link mechanism proximate its pivot joint strikes against the third stop 26, which occurs before the contact arm 7 reaches the shaft 24. As is clear from FIG. 4, the shaft 15 thus has its clockwise rotation around the shaft 14 restricted whereby the angle $\theta$ remains relatively large. Accordingly, when the switching handle 16 is moved to the right to close the contacts 4 and 6, the center line of the spring 17 quickly and easily passes over the shaft 14 with only a short operating stroke of the handle and using only a small force.

In such manual operation the third stop 26 being in the form of a plate arrests the leading edge 10A more firmly than if a pin stop were used. In this respect it is desirable that the third stop have a relatively broad or wide surface area so that the edge 10A is always positively limited in its travel. As the contact arm 7 does not strike against the shaft 24 during manual operation, the engagement between the crank 13 and the latch 23 as shown in FIG. 2 is not disturbed and therefore the contact between the crank and the latch is firmly maintained.

On the other hand when there is an overcurrent, shortcircuit current, or other abnormal electrical condition the crank 13 is released by the trip mechanism and the toggle link mechanism 10 operates in the same manner as the conventional breaker. In such automatic operation the contact arm 7 rotates in a counterclockwise direction until it strikes against the shaft 24, and accordingly the movable contact 6 is separated from the stationary contact 4 by a greater distance, as may be seen in FIG. 5, than when the breaker is opened manually. In such automatic operation the magnitude of the current to be interrupted is considerably higher than in manual operation, and it is thus desirable that the separation distance between the movable and stationary contacts be greater in the automatic as opposed to the manual mode.

When the circuit breaker is closed again the crank 13 is rotated in a counterclockwise direction by the handle 16, whereupon the crank is re-engaged with the latch 23 and the leading edge 10A of the link mechanism strikes against the third stop 26 to thus restrict the clockwise movement of the shaft 15 in the same manner as in manual operation.

In the automatic mode the closure of the contacts 4, 6 can be easily performed as explained above for the manual mode. With the construction of this invention it is thus possible to increase the separation distance between the movable contact 6 and the stationary contact 4 without strengthening the force of the spring 17 or increasing the operating stroke or throw of the handle 16.

What is claimed is:

1. In a circuit breaker including a stationary contact (4) a movable contact assembly (5) having a movable contact arm (7) and a movable contact (6) provided thereon and separable from said stationary contact; a switch handle (16) for manually opening or closing said contacts; a toggle mechanism (10) having a first link (11), a second link (12) having one end thereof pivotally connected to one end of said first link, the other end of said second link being connected to said movable contact arm, and a spring (17) connected between said handle and the pivotal connection of said links; a trip mechanism (23) operable in response to an abnormal current flow; an L-shaped bell crank (13) having a center portion thereof connected to the other end of said first link, engaged at its one end with said trip mechanism when said contacts are closed, and rotatable around a shaft (24) at its other end by the spring induced pivoting of said toggle mechanism links to separate said contacts when the crank is disengaged from said trip mechanism; the improvements characterized by:

(a) a fixed stop member (26) disposed in a path of movement of said toggle mechanism for direct abutment thereby to limit the degree of pivoting between said first and second links, and thereby the separation distance between the contacts, during manual contact separation, and (b) said shaft, against which the movable contact arm strikes during automatic contact separation, being disposed sufficiently far from said contact arm in its manually opened position to enable a greater separation distance between the contacts during automatic operation by said trip mechanism than during manual operation by said switch handle.

2. A circuit breaker according to claim 1 wherein said shaft remains spaced from said contact arm when a leading edge (10A) of said toggle mechanism strikes against said fixed stop member during manual contact separation.

3. A circuit breaker according to claim 1 or 2 wherein said stop member is provided within a space surrounded by said movable contact arm, said first and second links and said crank.

4. A circuit breaker according to claims 1 or 2 wherein said stop member is disposed facing the pivotal connection between said first and second links.

5. A circuit breaker according to claim 4, wherein said stop member is in the form of a plate having a sufficient width to ensure positive engagement by a leading edge of the toggle mechanism.

* * * * *